US010092469B1

(12) United States Patent
Lillevold

(10) Patent No.: US 10,092,469 B1
(45) Date of Patent: Oct. 9, 2018

(54) ROTATIONAL TRANSFER PLATFORM SYSTEM

(71) Applicant: Torrance D. Lillevold, Bemidji, MN (US)

(72) Inventor: Torrance D. Lillevold, Bemidji, MN (US)

( * ) Notice: Subject to any disclaimer, the term of this patent is extended or adjusted under 35 U.S.C. 154(b) by 0 days.

(21) Appl. No.: 15/620,525

(22) Filed: Jun. 12, 2017

(51) Int. Cl.
*A47B 91/00* (2006.01)
*A61G 7/053* (2006.01)

(52) U.S. Cl.
CPC ..... *A61G 7/053* (2013.01)

(58) Field of Classification Search
CPC .. A61G 7/053; A61H 3/04; A61H 2201/0161; F16M 11/38; F16M 11/40; A47B 2003/0824
USPC ..... 248/349.1; 135/74; 5/81.1 RP
See application file for complete search history.

(56) References Cited

U.S. PATENT DOCUMENTS 2,757,388 A * 8/1956 Chisholm ..... A61G 7/1038 135/65
3,872,945 A 3/1975 Hickman
5,526,541 A 6/1996 Massey
6,935,648 B2 8/2005 Beck
7,165,276 B2 * 1/2007 Hahn ..... A61G 7/1038 5/81.1 R
7,980,572 B2 7/2011 Bennett
9,345,631 B2 5/2016 Daneshvar
2001/0023507 A1 9/2001 James
2001/0032916 A1 * 10/2001 Wess ..... A61G 5/10 248/349.1
2005/0060801 A1 * 3/2005 Hahn ..... A61G 7/1038 5/81.1 R
2006/0162753 A1 7/2006 Grana
2006/0272090 A1 12/2006 Woodward
2015/0250674 A1 9/2015 Moore

* cited by examiner

*Primary Examiner* — Christopher Garft
(74) *Attorney, Agent, or Firm* — Neustel Law Offices

(57) ABSTRACT

A rotational transfer platform system which aids in transferring an immobile individual from one location to another. The rotational transfer platform system generally includes a platform which is rotatably connected to a base which is adapted to rest on the ground. A walker frame extends from the upper surface of the platform to aid in securing any individual standing on the platform. The walker frame may be adapted to transition between an expanded state for use and a collapsed state for transport or storage. A locking member may be utilized to selectively lock rotation of the platform with respect to the base in one of a plurality of different radial positions to ease with transferring an individual from one location to another.

15 Claims, 5 Drawing Sheets

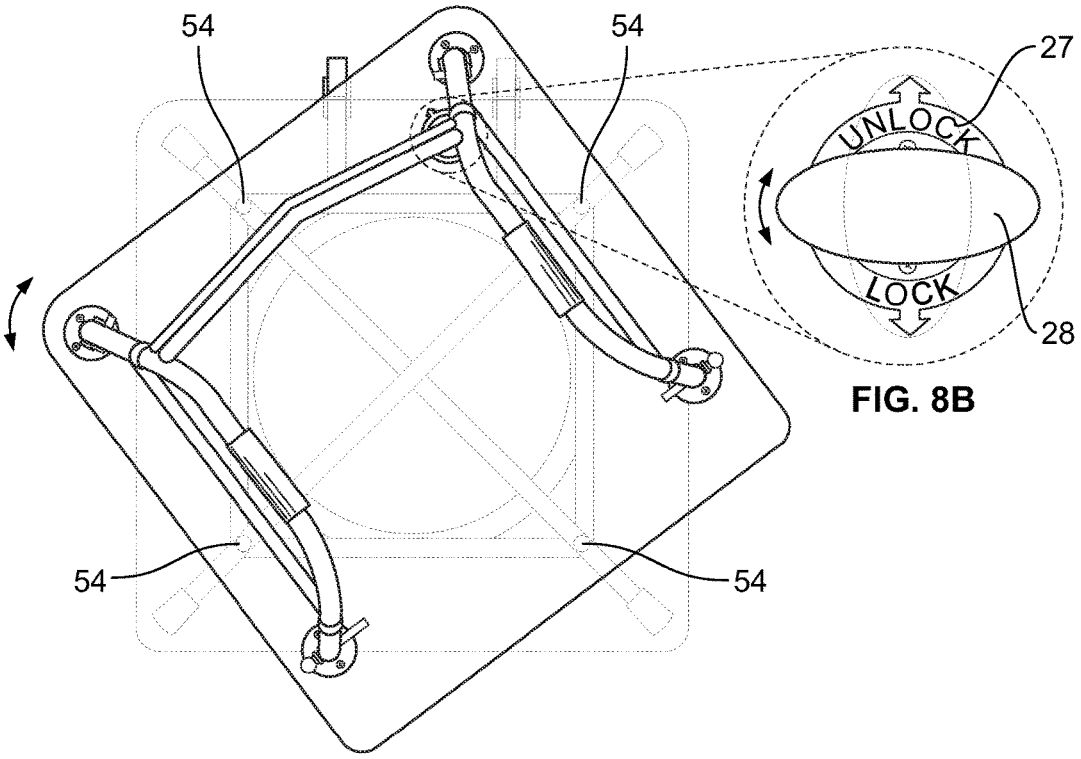
FIG. 8B
FIG. 8A
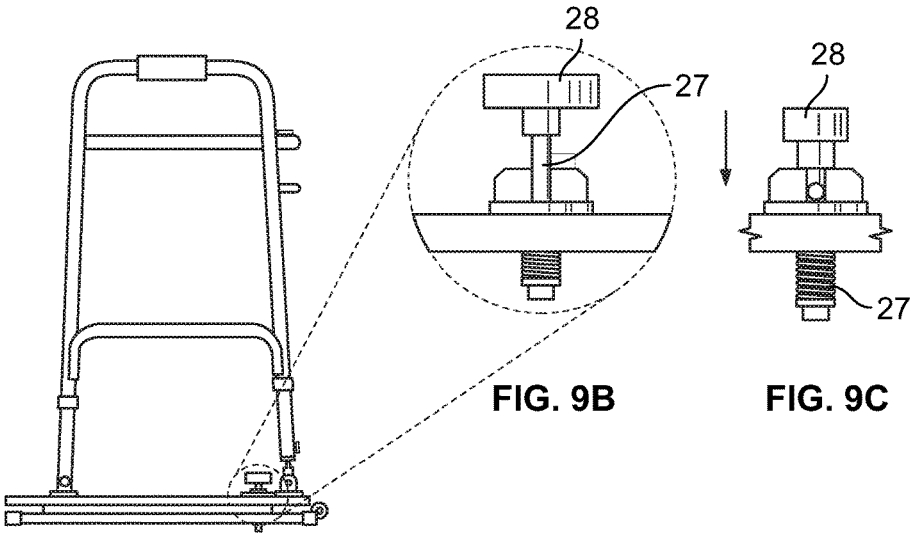
FIG. 9B
FIG. 9C
FIG. 9A

ROTATIONAL TRANSFER PLATFORM SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a rotational transfer platform system which aids in transferring an immobile individual from one location to another.

Related Art

Any discussion of the related art throughout the specification should in no way be considered as an admission that such related art is widely known or forms part of common general knowledge in the field.

The transport of immobile patients from one location to another is common in a wide range of areas, including in hospitals and nursing homes. It is important that such immobile patients be transported in a manner which is not only safe for the patients themselves, but also for any caretakers aiding in such transport. A common example would be the transport of an immobile patient from a wheelchair onto a bed.

In the past, such immobile patients have been moved in manners which heavily rely upon caretakers in aiding to move the patient. For example, a pair of caretakers may hold onto the patient and aid the patient in moving locations. This opens up the risk of injury both to the patient and to the caretakers. It would be far preferable to have a system to safely transport the patient that minimizes risk of injury to the patient or the caretakers during transport.

SUMMARY

An example embodiment is directed to a rotational transfer platform system. The rotational transfer platform system includes a platform which is rotatably connected to a base which is adapted to rest on the ground. A walker frame extends from the upper surface of the platform to aid in securing any individual standing on the platform. The walker frame may be adapted to transition between an expanded state for use and a collapsed state for transport or storage. A locking member may be utilized to selectively lock rotation of the platform with respect to the base in one of a plurality of different radial positions to ease with transferring an individual from one location to another.

There has thus been outlined, rather broadly, some of the embodiments of the rotational transfer platform system in order that the detailed description thereof may be better understood, and in order that the present contribution to the art may be better appreciated. There are additional embodiments of the rotational transfer platform system that will be described hereinafter and that will form the subject matter of the claims appended hereto. In this respect, before explaining at least one embodiment of the rotational transfer platform system in detail, it is to be understood that the rotational transfer platform system is not limited in its application to the details of construction or to the arrangements of the components set forth in the following description or illustrated in the drawings. The rotational transfer platform system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 8*a* is a top sectional view of a rotational transfer platform system illustrating rotation of the platform in accordance with an example embodiment.

FIG. 8*b* is a top view of a locking member of a rotational transfer platform system illustrating the locking and unlocking of the locking member in accordance with an example embodiment.

FIG. 9*a* is a side view of a rotational transfer platform system in an expanded and locked state in accordance with an example embodiment.

FIG. 9*b* is a side view of a locking member of a rotational transfer platform system in an unlocked state in accordance with an example embodiment.

FIG. 9*c* is a side view of a locking member of a rotational transfer platform system in a locked state in accordance with an example embodiment.

DETAILED DESCRIPTION

A. Overview

Figure 1:
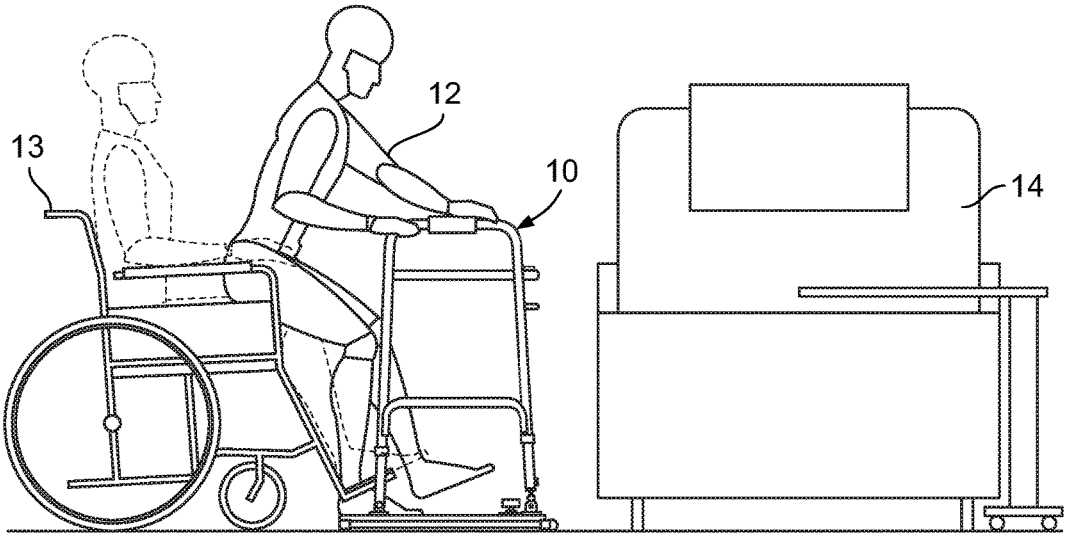
FIG. 1 is a perspective view of a rotational transfer platform system in being used to aid a patient from a wheelchair accordance with an example embodiment.

An example rotational transfer platform system generally comprises a platform 20 which is rotatably connected to a base 50 which is adapted to rest on the ground. A walker frame 30 extends from the upper surface 23 of the platform 20 to aid in securing any individual standing on the platform 20. The walker frame 30 may be adapted to transition between an expanded state for use and a collapsed state for transport or storage. A locking member 27 may be utilized to selectively lock rotation of the platform 20 with respect to the base 50 in one of a plurality of different radial positions to ease with transferring an individual from one location to another.

The rotational transfer platform system may comprise a platform 20 comprising an upper surface 23 and a lower surface 24. A walker frame 30 is connected to the upper surface 23 of the platform 20, with the walker frame 30 being adapted to be at least partially collapsed onto the upper surface 23 of the platform 20. A base 50 adapted to contact a ground surface is provided; with the lower surface 22 of the platform 20 being rotatably connected to the base 50 by a bearing 55.

The walker frame 30 may be adjustable between a first position in which the walker frame 30 is upright on the upper surface 23 of the platform 20 and a second position in which the walker frame 30 is collapsed onto the upper surface of the platform 20. The walker frame may comprise one or more frontal supports 31, 35 and one or more rear supports 40, 43; with the rear supports 40, 43 being hingedly connected to the platform 20 and the frontal supports 31, 35 being removably connected to the platform 20. The frontal supports 31, 35 may define a gap to provide access on to or off of the platform 20. One or more cross supports 46 may extend between the rear supports 40, 43; with a first rear support 40 being hingedly connected to a first end of the cross support 46 and a second rear support 43 being hingedly connected to a second end of the cross support 46. The walker frame 30 is adapted to be collapsed by disconnected the frontal supports 31, 35 from the platform 20 and rotating the frontal supports 31, 35 to rest on the platform 20.

One or more anchors 25 may be on the upper surface 23 of the platform 20; with the frontal supports 31, 35 being connected to the anchors 25 and the rear supports 40, 43 being disconnected from the anchors 25 when the walker frame 30 is in the first, expanded position. The rear supports 40, 43 are connected to the anchors 25 and the frontal supports 31, 35 are disconnected from the anchors 25 when the walker frame 30 is in the second, collapsed position; with the anchors 25 securing the collapsed supports 31, 35, 40, 43 against the upper surface 23 of the platform 20. In the exemplary embodiment of the figures, a first anchor 25 and a second anchor 25 are shown on the upper surface 23 of the platform 20; with the first frontal support 31 being connected to the first anchor 25 and the second frontal support 35 being connected to the second anchor 25 when the walker frame 30 is in the first position and the first rear support 40 being connected to the first anchor 25 and the second rear support 43 being connected to the second anchor 25 when the walker frame 30 is in the second, collapsed position.

A locking member 27 such as a pin or the like may be provided for locking the platform 23 into one of a plurality of rotational positions with respect to the base 50. The base 50 may include a plurality of lock receivers 54 such as openings which are each adapted to selectively engage with the locking member 27 to lock the platform 20 into one of the plurality of rotational positions with respect to the base.

One or more wheels 58 may extend from the base 50 in a direction parallel with an axis extending across the upper surface 23 of the platform 20 (in a horizontal direction when the platform 20 is resting on a ground surface). The wheels 58 will only engage with the ground surface when the platform 20 is tiled diagonally to aid in transport.

B. Platform

As best shown in FIGS. 1-4, a platform 20 is utilized on which a patient 12 may stand when the present invention is in use. The platform 20 is adapted to be rotated with respect to the base 50 to maneuver a patient 12 between various locations; such as between a wheelchair 13 and a bed 14. The shape, size, and configuration of the platform 20 may vary in different embodiments and thus should not be construed as limited by the exemplary figures.

Figure 3:
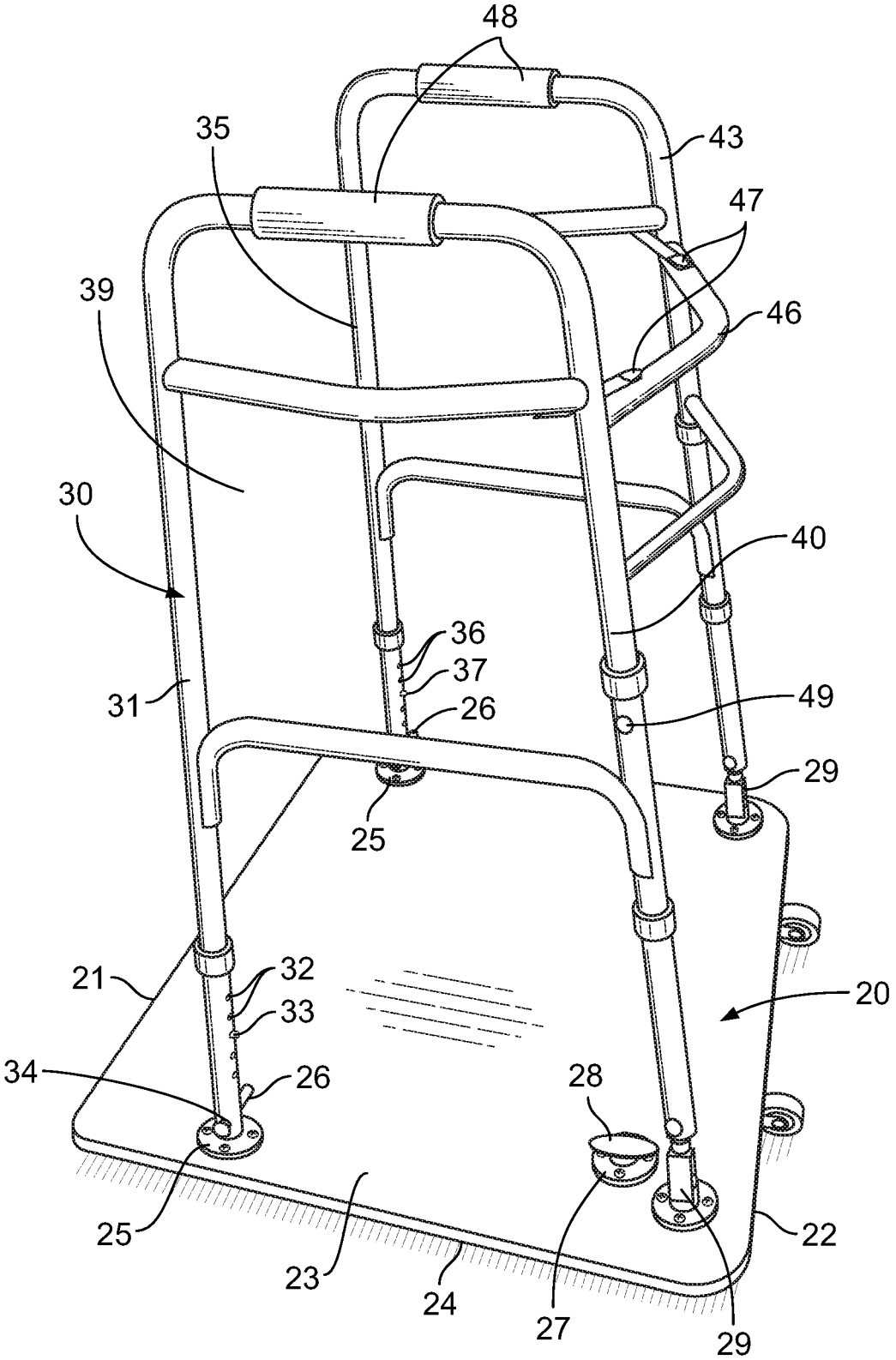
FIG. 3 is an upper perspective view of a rotational transfer platform system in an expanded state in accordance with an example embodiment.

The platform 20 is shown in FIG. 3 as comprising a rectangular structure having a front end 21, a rear end 22, an upper surface 23, and a lower surface 24. The front end 21 of the platform 20 is generally utilized by the patient 12 to get on or get off the platform 20. The rear end 22 of the platform 20 may include wheels 58 as described herein to aid in transporting the platform 20 when in its collapsed state.

The upper surface 23 of the platform 20 includes a collapsible walker frame 30. The walker frame 30 in some embodiments may be completely removable from the platform 20. In other embodiments, the walker frame 30 may be partially removable from the platform 20 to allow the walker frame 30 to be collapsed onto the platform 20 for transport.

The upper surface 23 of the platform 20 may include anchors 25 to which one or more of the supports 31, 35, 40, 43 may be fixedly or removably connected. Each of the anchors 25 may include an opening extending therethrough to selectively receive an anchor pin 26 for connecting the support 31, 35, 40, 43 to the anchor 25. In the embodiment shown in FIG. 3, the first frontal support 31 is connected to a first anchor 25 by a first anchor pin 26 and the second frontal support 35 is connected to a second anchor 25 by a second anchor pin 26. Various other configurations may be utilized in different embodiments.

The upper surface 23 of the platform 20 may also include hinges 29 to which one or more supports 31, 35, 40, 43 of the walker frame 30 are hingedly connected. The hinges 29 may be fixedly or removably connected to the platform 20. In the exemplary figures, the rear supports 40, 43 of the walker frame 30 are illustrated as being connected to the platform 20 via hinges 29 near the rear end 22 of the platform 20.

The lower surface 24 of the platform 20 is connected to the base 50 via a bearing 55. In the embodiment shown in the figures, the bearing 55 is connected between the lower surface 24 of the platform 20 and the base 50 such that the platform 20 may freely rotate with respect to the base 50 if not locked.

The platform 20 may also include a locking member 27 as best shown in FIGS. 9A, 9B, and 9C. The locking member 27 may extend through the platform 20 from its upper surface 23 to its lower surface 24. The locking member 27 is preferably adapted to extend downwardly to selectively engage with a corresponding lock receiver 54 on the base 50 to selectively prevent rotation of the platform 20 with respect to the base 50 as discussed herein.

Various types of locking members 27 may be utilized, such as pins, clamps, or the like. In the exemplary figures, the locking members 27 are configured to extend downwardly and engage with the base 50 to lock the platform 20 and retract upwardly and disengage from the base 50 to unlock the platform 20. The locking member 27 may include a locking handle 28 which may be rotated, pushed, pulled, or otherwise adjusted to engage or disengage the locking member 27.

C. Walker Frame

As shown throughout the figures, a walker frame 30 is positioned on the upper surface 23 of the platform 20. The walker frame 30 aids a patient 12 in getting on and getting off the platform 20; as well as providing stability while on the platform 20 itself, such as while the platform 20 is being rotated. The walker frame 30 is preferably adapted to be collapsed onto the upper surface 23 of the platform 20 when not in use to ease storage and transport of the present invention.

Figure 4:
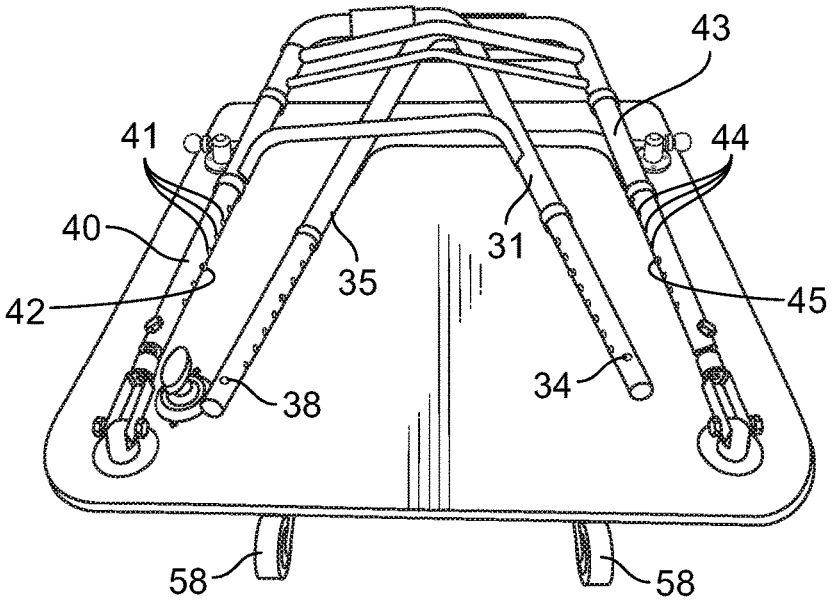
FIG. 4 is an upper perspective view of a rotational transfer platform system in a collapsed state in accordance with an example embodiment.

As shown in FIGS. 3 and 4, the walker frame 30 is adapted to transition between a first, expanded state in which the walker frame 30 may be relied upon for support by a patient 20 and a second, collapsed state in which at least a portion of the walker frame 30 is collapsed onto the upper surface 23 of the platform 20 such that the present invention is more compact for transport and storage. The walker frame 30 may be fully or partially collapsible in different embodiments. The manner in which the walker frame 30 is collapsed, and the portions of the walker frame 30 which are collapsible, may vary in different embodiments.

The shape, size, and structure of the walker frame 30 may vary in different embodiments and should not be construed as limited by the figures. As shown in FIG. 3, the walker frame 30 may comprise a first frontal support 31 and a second frontal support 35 which are positioned near the front end 21 of the platform 20. The walker frame 30 may also comprise a first rear support 40 and a second rear support 43 which are positioned near the rear end 22 of the platform 20. Each of the supports 31, 35, 40, 43 will generally comprise rods, bars, or other elongated structures which may serve as supports on which the patient 12 may lean or which the patient 12 may grasp for stability when getting on, getting oft or standing on the platform 20.

As shown in the figures, the walker frame 30 may include a first frontal support 31 and a second frontal support 35 at or near the front end 21 of the platform 20 on its upper surface 23. The frontal supports 31, 35 may be fixedly or removably connected to the platform 20. A gap 39 between the frontal supports 31, 35 allows access to step up onto or step down off of the upper surface 23 of the platform 20 by a patient 12.

The frontal supports 31, 35 may be height-adjustable in some embodiments. The frontal supports 31, 35 may be telescopically-adjustable as shown in the figures or may otherwise be adjusted in height. This allows for the frontal supports 31, 35 to be adjusted to suit different types of patients 12.

The first frontal support 31 may thus include a plurality of first adjustment openings 31 extending along at least a portion of its length and the second frontal support 35 may include a plurality of second adjustment openings 36 extending along at least a portion of its length. A first adjustment pin 33 may be removably and selectively inserted within one of the first adjustment openings 32 and the second adjustment pin 37 may be removably and selectively inserted within one of the second adjustment openings 36 to lock the first and second frontal supports 31, 35 at a specific height to telescopically adjust the frontal supports 31, 35.

Figure 5:
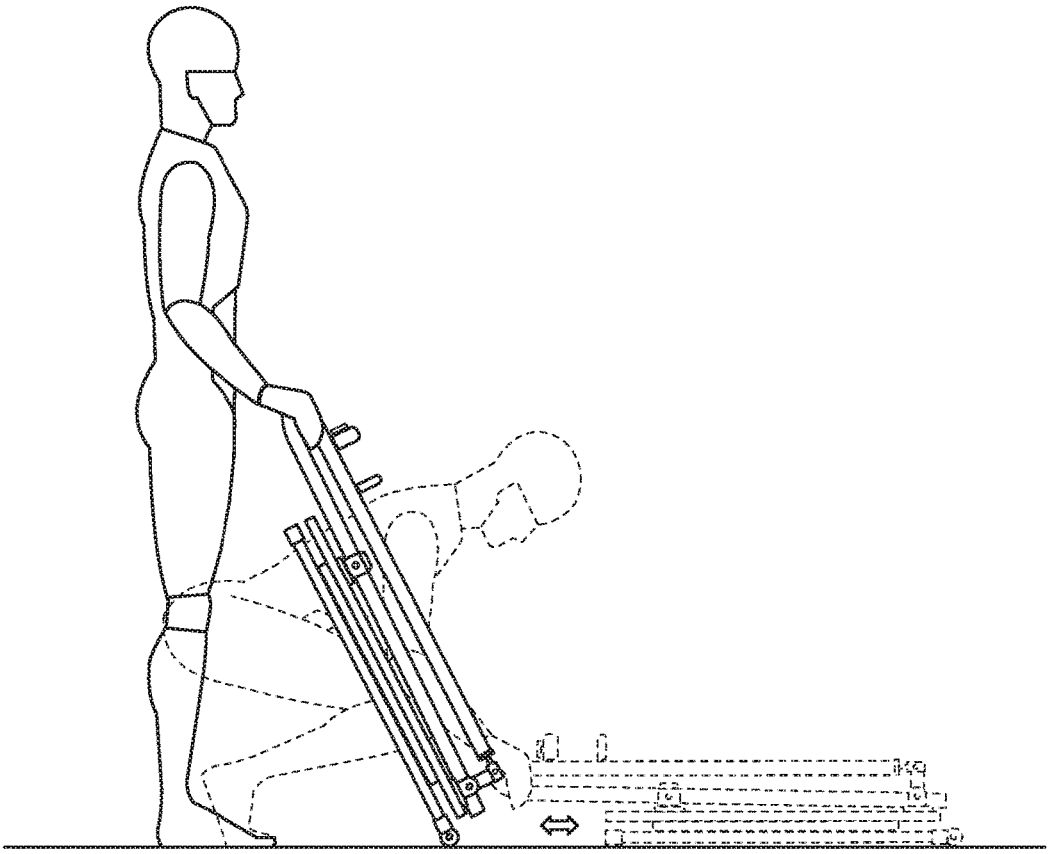
FIG. 5 is an upper perspective view of a rotational transfer platform system being transported in a collapsed state in accordance with an example embodiment.
Figure 6:
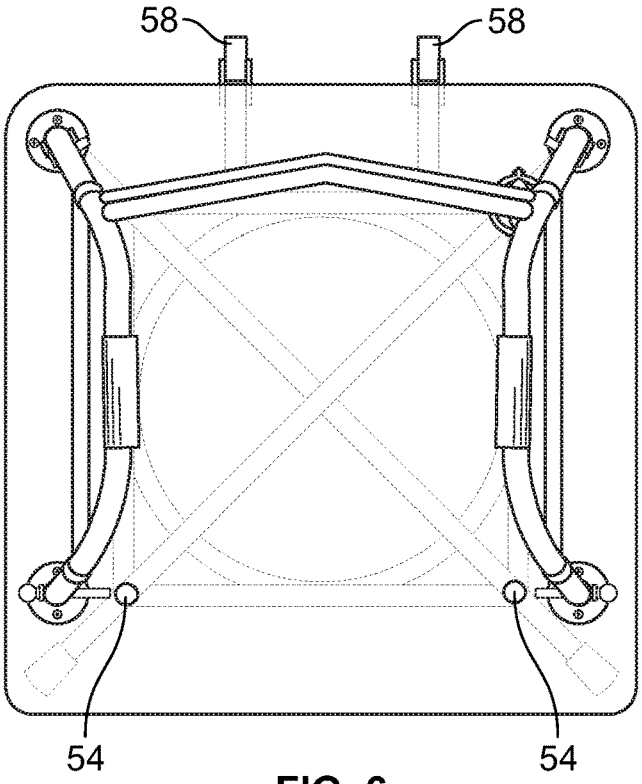
FIG. 6 is a top view of a rotational transfer platform system in accordance with an example embodiment.
Figure 7:
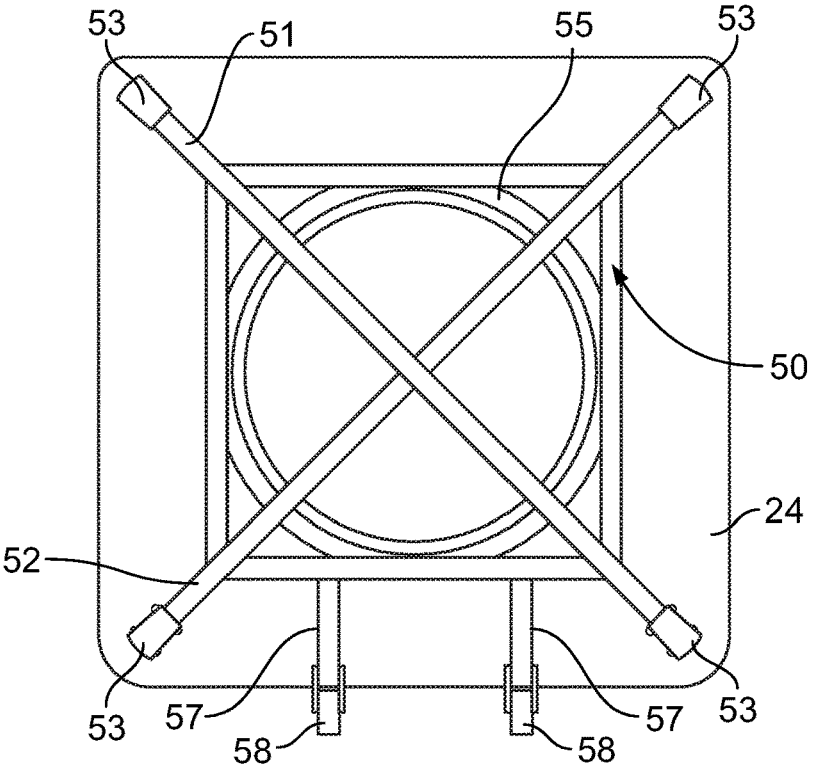
FIG. 7 is a bottom view of a rotational transfer platform system in accordance with an example embodiment.

Each of the frontal supports 31, 35 are preferably removably connected to the platform 20. The frontal supports 31, 35 may be disconnected from the platform 20 to collapse the walker frame 30 into its collapsed state such as shown in FIGS. 4 and 5.

Each of the frontal supports 31, 35 is preferably removably connected to the platform 20 via use of anchors 25 on the upper surface 23 of the platform 20. The first frontal support 31 may include a first anchor opening 34 which is aligned with an anchor 25 such that an anchor pin 26 may be removably inserted within the first anchor opening 34 to removably connect the first frontal support 31 to the platform 20. The second frontal support 35 may similarly include a second anchor opening 38 which is aligned with an anchor 25 such that an anchor pin 26 may be removably inserted within the second anchor opening 38 to removably connect the second frontal support 35 to the platform 20.

As shown in the figures, the walker frame 30 may include a first rear support 40 and a second rear support 43 at or near the rear end 22 of the platform 20 on its upper surface 23. The rear supports 40, 43 may be fixedly or removably connected to the platform 20. In a preferred embodiment as shown in the figures, the rear supports 40, 43 are hingedly connected to the platform 20 such that the rear supports 40, 43 may be rotated downwardly to rest on the platform 20 when the walker frame 30 is in its collapsed state.

The rear supports 40, 43 may be height-adjustable in some embodiments. The rear supports 40, 43 may be telescopically-adjustable as shown in the figures or may otherwise be adjusted in height. This allows for the height of the rear supports 40, 43 to be adjusted to suit different types of patients 12.

The first rear support 40 may thus include a plurality of third adjustment openings 41 extending along at least a portion of its length and the second rear support 43 may include a plurality of fourth adjustment openings 44 extending along at least a portion of its length. A third adjustment pin 42 may be removably and selectively inserted within one of the third adjustment openings 41 and the fourth adjustment pin 45 may be removably and selectively inserted within one of the fourth adjustment openings 44 to lock the first and second rear supports 40, 43 at a specific height to telescopically adjust the rear supports 40, 43.

As best shown in FIG. 3, one or more cross supports 46 may extend between the first and second rear supports 40, 43. The frontal supports 31, 35 do not include cross supports 46 to allow for the gap 39 through which a patient 12 may pass to get on or get off the walker frame 30. The cross supports 46 may be hingedly connected to the rear supports 40, 43 by one or more support hinges 47. This allows for the rear supports 40, 43 to rotate inwardly with respect to the cross supports 46 to collapse the walker frame 30 into its collapsed state such as shown in FIGS. 4 and 5.

The rear supports 40, 43 are preferably hingedly connected to the platform 20 so that the rear supports 40, 43 may be hingedly rotated downwardly toward the platform 20 when collapsing the walker frame 30 or hingedly rotated upwardly away from the platform 20 when expanding the walker frame 30. Thus, each of the rear supports 40, 43 may be connected at their lower ends to the platform 20 by hinges 29 which are positioned on the upper surface 21 of the platform 20.

The rear supports 40, 43 may also each include a rear anchor opening 49 along their lengths. When the rear supports 40, 43 are collapsed onto the platform 20, the rear supports 40, 43 may be removably connected to the anchors 25 via the same anchor pins 26 such as shown in FIG. 4 which connect the frontal supports 31, 35 to the platform 20 when the walker frame 30 is in its expanded state.

A pair of handles 48 may extend from the rear supports 40, 43 to the frontal supports 21, 25. In the exemplary figures, a first handle 48 extends between the first frontal support 21 and the first rear support 40 and a second handle 48 extends between the second frontal support 25 and the second rear support 43. The handles 48 may be grasped by a patient 12 when on the platform 20.

D. Base

As shown throughout the figures, the platform 20 is rotatably connected to a base 50 such that the platform 20 may rotate with respect to the base 50. The base 50 is adapted to rest on the floor; with the platform 20 not directly contacting the floor. The height at which the platform 20 is positioned above the floor by the base 50 may vary in different embodiments.

The base 50 may comprise various configurations, such as the use of a frame of cross members 51, 52 as shown in the figures; with a first cross member 51 extending diagonally across the lower surface 24 of the platform 20 in a first direction and a second cross member 52 extending diagonally across the lower surface 24 of the platform 20 to form an "X-shaped" configuration. The distal ends of the cross members 51, 52 may include feet 53 which are adapted to engage with and frictionally secure the base 50 against the floor.

The base 50 may include a plurality of lock receivers 54 with which the locking member 27 may removably engage to lock the platform 20 from rotation with respect to the base 50 in a plurality of positions. In the exemplary figures, there are four lock receivers 54 which are each separated by approximately ninety degree increments of rotation.

In this manner, the platform 20 may be locked from rotation in one of four different rotational positions with respect to the base 50. The lock receivers 54 may comprise openings on the base 50, such as within the cross members 51, 52, which are adapted to removably receive and retain the locking member 27 to prevent rotation of the platform 20 with respect to the base 50.

As shown in the figures, a bearing 55 is connected between the platform 20 and the base 50 such that the base 50 and platform 20 are not directly in contact. The bearing 55 allows the platform 20 to freely rotate with respect to the base 50 when the locking member 27 is not engaged within any of the lock receivers 54 of the base 50. Various types of bearings 55 may be utilized and thus the structure, configuration, shape, and size of the exemplary bearing 55 shown in the figures should not be construed as limiting on the scope of the present invention.

As best shown in FIGS. 4-8, one or more wheels 58 may extend horizontally outward from underneath the base 50. In the exemplary embodiment of FIGS. 6 and 7, a pair of horizontally-oriented wheel supports 57 extend outwardly along parallel with the axis extending across the upper surface 23 of the platform 20. Each of the wheels supports 57 includes a wheel 58 at its distal end. The wheels 58 extend outwardly from underneath the platform 20 such that the wheels 58 do not contact the ground underneath the platform 20 when the platform 20 is lying flat. The wheels 58 only engage with the ground when the platform 20 is tilted such as shown in FIG. 5 to ease transport of the present invention.

E. Operation of Preferred Embodiment

In use, the walker frame 30 should first be expanded for use before having a patient utilize the present invention. The anchor pins 26 are first disengaged from the anchors 25 to disconnect the rear supports 40, 43 from the platform 20. The rear supports 40, 43 may then be rotated into an upright orientation by use of the hinges 29 and then rotated outwardly away from the cross supports 46 by use of the support hinges 47.

The frontal supports 31, 35 may then be connected to the same anchors 25 via the same anchor pins 26 to connect the frontal supports 31, 35 to the platform 20 and form the complete walker frame 30. The height of the frontal supports 31, 35 may be adjusted using the first and second adjustment openings 32, 36 and first and second adjustment pins 33, 37. Similarly, the height of the rear supports 40, 43 may be adjusted using the third and fourth adjustment openings 41, 44 and third and fourth adjustment pins 42, 45.

With the walker frame 30 in its expanded state, a patient 12 may utilize the present invention. Generally, the present invention may be utilized to transfer a patient 12 easily from one location to another. An example shown in the figures relates to transferring a patient 12 from a wheelchair 13 to a bed 14 (or vice versa). The functionality of the present invention should not be construed as limited in this respect, as the methods and systems described herein could be utilized for a wide range of other purposes. For example, the present invention could be utilized for functions unrelated to patients 12; such as to move an object such as a bulky or heavy object from one location to another.

As shown in FIG. 1, the platform 20 is first positioned and oriented such that the gap 39 of the walker frame 30 faces the patient 12 in his/her original position, such as in a wheelchair 13. The locking member 27 may then be engaged to prevent unintentional rotation of the platform 20 when the patient is stepping onto the platform 20. With the platform 20 locked and the gap 39 in the walker frame 30 facing the patient 12, the patient 12 may step up or be helped to step up onto the platform 20; using the walker frame 30 for additional stability.

Figure 2:
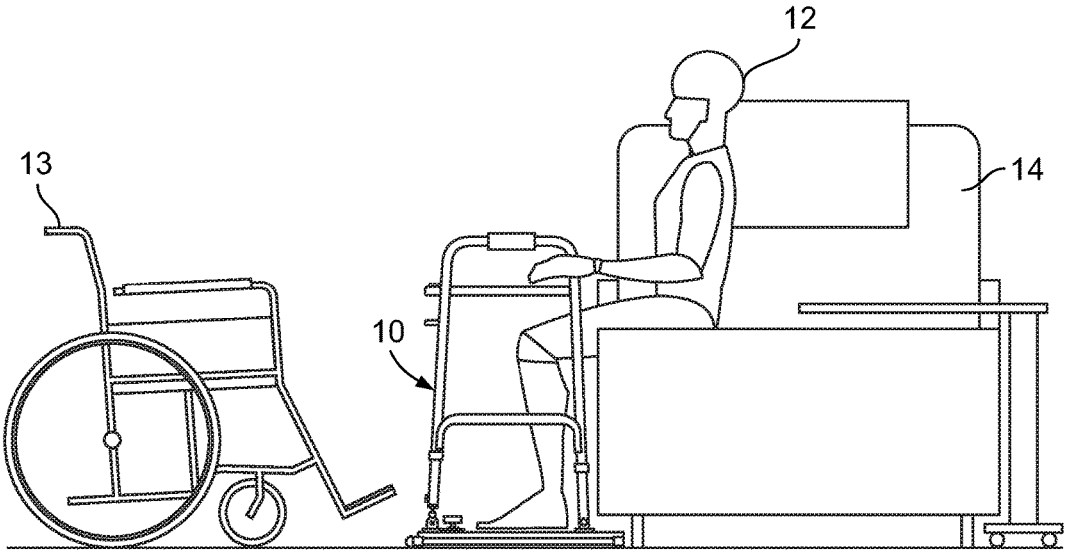
FIG. 2 is a perspective view of a rotational transfer platform system in being used to aid a patient onto a bed accordance with an example embodiment.

With the patient 12 secured on the platform 20, the locking member 27 may be disengaged to allow for the platform 20 to be rotated with respect to the base 50. The platform 20 is then rotated with the patient 12 on the platform 20 such that the gap 39 faces the desired location to which the patient 12 is being moved, such as a bed 14 as shown in FIG. 2. The locking member 27 may then be engaged again to prevent further rotation of the platform 20 when the patient 12 is getting off the platform 20. With the locking member 27 engaged to prevent rotation of the platform 20 and the gap 39 facing the destination location for the patient 12, the patient 12 may step off or be helped to step off the platform 20 and onto the desired location, such as a bed 14.

Once the patient 12 has been safely moved, the platform 20 may be utilized for additional patients 12 in the same location or may be moved to another location to service additional patients 12 or for storage. To ease transport and storage, the walker frame 30 may be collapsed onto the platform 20 such as shown in FIG. 4.

To collapse the walker frame 30, the frontal supports 31, 35 are first disconnected from the platform 20 by removing the anchor pins 26 from the anchors 25 which connect the frontal supports 31, 35 to the platform 20. The rear supports 40, 43 may then be rotated inwardly and then rotated downwardly to rest on the platform 20 such as shown in FIG. 4. The rear supports 40, 43 may be secured against the platform 20 using the same anchors 25 and anchor pins 26.

With the walker frame 30 in a collapsed state, an individual may grasp the handles 48 to tilt the platform 20 upwardly and engage the wheels 58 with the ground. The present invention may then be transported in such a tilted orientation with the wheels 58 aiding its movement as shown in FIG. 5.

Unless otherwise defined, all technical and scientific terms used herein have the same meaning as commonly understood by one of ordinary skill in the art to which this invention belongs. Although methods and materials similar to or equivalent to those described herein can be used in the practice or testing of the rotational transfer platform system, suitable methods and materials are described above. All publications, patent applications, patents, and other references mentioned herein are incorporated by reference in their entirety to the extent allowed by applicable law and regulations. The rotational transfer platform system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A rotational transfer platform system, comprising:

a platform comprising an upper surface and a lower surface;

a walker frame connected to the upper surface of the platform, wherein the walker frame is adapted to be at least partially collapsed onto the upper surface of the platform, wherein the walker frame comprises a frontal support and a rear support;

wherein the walker frame is adjustable between a first position in which the walker frame is expanded upright on the upper surface of the platform and a second position in which the walker frame is collapsed onto the upper surface of the platform;

an anchor on the upper surface of the platform, the anchor including a pin, wherein the pin is adjustable;

wherein in the first position the pin of the anchor is removably connected to the frontal support so as to support the walker frame when upright on the platform, wherein in the second position the pin of the anchor is removably connected to the rear support so as to support the walker frame against the platform when collapsed; and a base adapted to contact a ground surface, wherein the lower surface of the platform is rotatably connected to the base by a bearing.

2. The rotational transfer platform system of claim 1, wherein the rear support is hingedly connected to the platform.

3. The rotational transfer platform system of claim 2, wherein the frontal support is removably connected to the platform.

4. The rotational transfer platform system of claim 3, wherein the walker frame is adapted to be collapsed by disconnecting the frontal support from the platform and rotating the frontal support to rest on the platform.

5. The rotational transfer platform system of claim 1, further comprising a locking member for locking the platform into one of a plurality of rotational positions with respect to the base.

6. The rotational transfer platform system of claim 5, wherein the base includes a plurality of lock receivers each adapted to selectively engage with the locking member to lock the platform into one of the plurality of rotational positions with respect to the base.

7. The rotational transfer platform system of claim 1, further comprising a wheel extending from the base in a direction parallel with an axis extending across the upper surface of the platform.

8. A rotational transfer platform system, comprising:

a platform comprising an upper surface and a lower surface;

a walker frame connected to the upper surface of the platform, wherein the walker frame comprises a first frontal support, a second frontal support, a first rear support, and a second rear support, wherein the walker frame is adjustable between a first position in which the walker frame is expanded upright on the upper surface of the platform and a second position in which the walker frame is collapsed onto the upper surface of the platform;

a first anchor on the upper surface of the platform, the first anchor including a first pin;

a second anchor on the upper surface of the platform, the second anchor including a second pin;

wherein in the first position the first pin of the first anchor is removably connected to the first frontal support and the second pin of the second anchor is removably connected to the second frontal support so as to support the walker frame when upright on the platform, wherein in the second position the first pin of the first anchor is removably connected to the first rear support and the second pin of the second anchor is removably connected to the second rear support so as to support the walker frame against the platform when collapsed;

a bearing connected to the lower surface of the platform;

a base connected to the bearing, wherein the platform is rotatably connected to the base; and a locking member for locking the platform into one of a plurality of rotational positions with respect to the base.

9. The rotational transfer platform system of claim 8, wherein the first frontal support and the second frontal support are each removably connected to the upper surface of the platform.

10. The rotational transfer platform system of claim 9, wherein the first rear support and the second rear support are each hingedly connected to the upper surface of the platform.

11. The rotational transfer platform system of claim 10, wherein the first frontal support and the second frontal support define a gap to provide access on to or off of the platform.

12. The rotational transfer platform system of claim 11, further comprising a cross support extending between the first rear support and the second rear support.

13. The rotational transfer platform system of claim 12, wherein the first rear support is hingedly connected to a first end of the cross support and the second rear support is hingedly connected to a second end of the cross support.

14. The rotational transfer platform system of claim 8, further comprising a wheel extending from the base underneath the platform in a direction parallel with an axis extending across the upper surface of the platform.

15. The rotational transfer platform system of claim 8, wherein the base comprises a plurality of lock receivers each adapted to selectively engage with the locking member to lock the platform into one of the plurality of rotational positions with respect to the base.

* * * * *